US010012046B2

(12) United States Patent
Ewing et al.

(10) Patent No.: US 10,012,046 B2
(45) Date of Patent: Jul. 3, 2018

(54) BI-DIRECTIONAL LOCKING LINER HANGER WITH PRESSURE BALANCED SETTING MECHANISM

(71) Applicant: Baker Hughes Incorporated, Houston, TX (US)

(72) Inventors: Daniel C. Ewing, Katy, TX (US); Robert A. Pena, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 269 days.

(21) Appl. No.: 14/254,293

(22) Filed: Apr. 16, 2014

(65) Prior Publication Data

US 2015/0300111 A1 Oct. 22, 2015

(51) Int. Cl.
*E21B 23/04* (2006.01)

(52) U.S. Cl.
CPC ..... *E21B 23/04* (2013.01)

(58) Field of Classification Search
CPC . E21B 23/04; E21B 23/00; E21B 4/18; E21B 23/01; E21B 43/10
See application file for complete search history.

(56) References Cited

U.S. PATENT DOCUMENTS

| | | | | |
|---|---|---|---|---|
| 3,603,205 | A * | 9/1971 | Shearer, Jr. | F15B 15/26 91/45 |
| 4,711,326 | A | 12/1987 | Baugh et al. | |
| 5,086,845 | A | 2/1992 | Baugh | |
| 7,766,088 | B2 | 8/2010 | Saucier et al. | |
| 8,393,401 | B2 * | 3/2013 | Yokley | E21B 17/06 166/208 |
| 2005/0006106 | A1 * | 1/2005 | Hirth | E21B 43/10 166/382 |
| 2011/0247832 | A1 * | 10/2011 | Harris | E21B 33/04 166/382 |
| 2012/0234530 | A1 * | 9/2012 | Tait | E21B 41/00 166/66.5 |
| 2013/0092369 | A1 | 4/2013 | Stingerie | |

OTHER PUBLICATIONS

Baker Hughes, Baker Oil Tools Liner Hange System Technical Unit; FLEX-LOCK II, Double Grip and Body; Oct. 2013.

* cited by examiner

*Primary Examiner* — David J Bagnell
*Assistant Examiner* — Manuel C Portocarrero
(74) *Attorney, Agent, or Firm* — Steve Rosenblatt

(57) ABSTRACT

A liner hanger features a pressure balanced setting sleeve system that applies no net force to the slips when internal pressure is raised in access ports associated with opposed actuation sleeves such that applied pressure results in opposed forces that cancel each other out. When one of the sleeves is isolated from tubing pressure and the other port to the other sleeve is pressurized, the bi-directional slips are extended and their extended position is locked with a lock ring to hold the set of the liner hanger against release.

10 Claims, 4 Drawing Sheets

BI-DIRECTIONAL LOCKING LINER HANGER WITH PRESSURE BALANCED SETTING MECHANISM

FIELD OF THE INVENTION

The field of the invention is liner hangers and more particularly hangers that resist forces in opposed direction while locking a set while preventing premature actuation with a pressure balanced setting mechanism.

BACKGROUND OF THE INVENTION

Liner hangers are used to support one string off another in subterranean locations. Some designs have slips that resist applied forces in opposed directions. This is typically accomplished by the orientation of surface wickers on slip elements. At times the liner hanger sets prematurely before reaching the desired location. In those events the release mechanism has to be applied and the hanger brought to the surface and redressed. Alternatively, the liner hanger can be resettable in response to hydraulic pressure and further feature a mechanical lock to keep the liner hanger from setting between movements as described in US 20130092369.

There are applications where premature setting is not desirable but also where once the hanger is set it is beneficial to be able to lock the set in a hanger that can resist forces in opposed directions. These and other features of the present invention will be more readily apparent to those skilled in the art from a review of the detailed description of the preferred embodiment and the associated drawings while recognizing that the full scope of the invention is to be determined from the appended claims.

SUMMARY OF THE INVENTION

A liner hanger features a pressure balanced setting sleeve system that applies no net force to the slips when internal pressure is raised in access ports associated with opposed actuation sleeves such that applied pressure results in opposed forces that cancel each other out. When one of the sleeves is isolated from tubing pressure and the other port to the other sleeve is pressurized, the bi-directional slips are extended and their extended position is locked with a lock ring to hold the set of the liner hanger against release.

DETAILED DESCRIPTION OF THE PREFERRED EMBODIMENT

Figure 1:
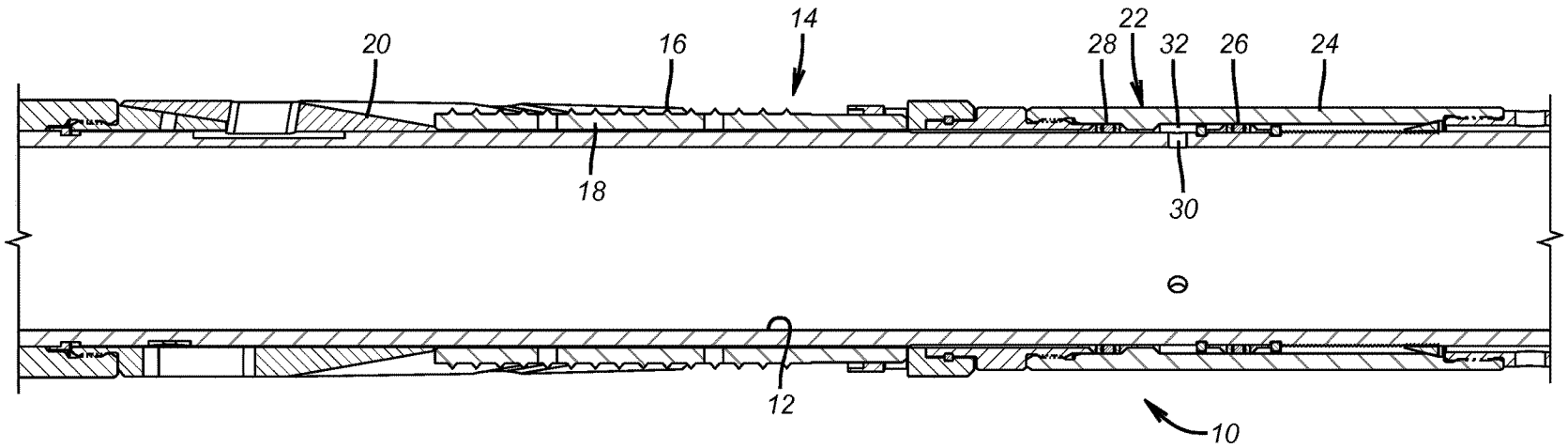
FIG. 1 is a section view in the run in position showing the slips and upper setting cylinder.
Figure 3:
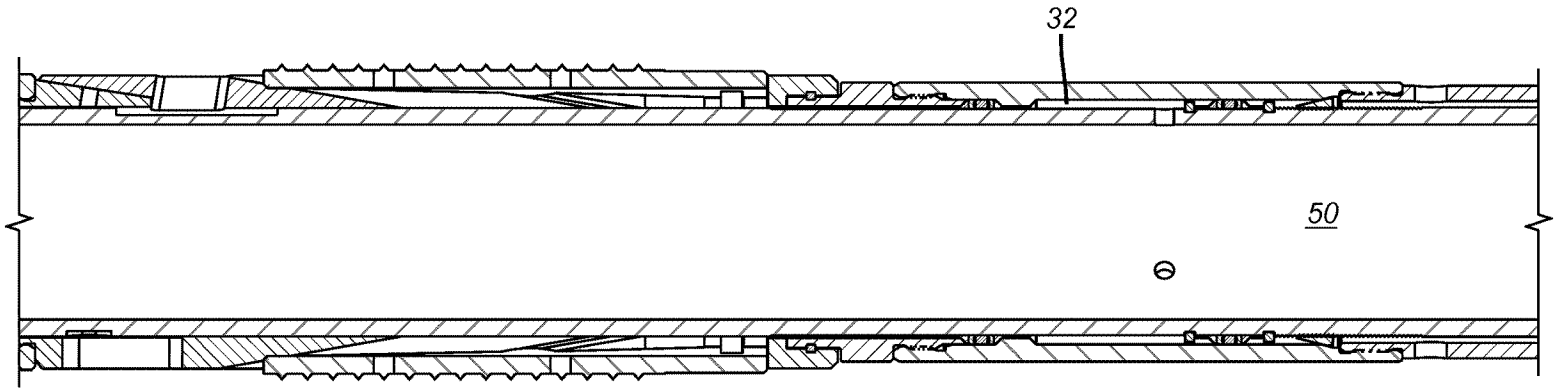
FIG. 3 is the view of FIG. 1 in the set position.

Referring to FIG. 1, the hanger 10 has a mandrel 12 on which is disposed the slip assembly 14 which has wickers 16 that are oriented in opposed mirror image format to resist release forces that can come in opposed directions. The shape of the wickers 16 allows them to resist uphole or downhole oriented forces. The slips can be circumferentially spaced apart or adjacent each other to form a ring shape. In FIG. 1 the spaced apart slips 18 of the assembly 14 each ride up ramps such as 20 for radial extension as a result of axial movement, as will be explained below.

Figure 2:
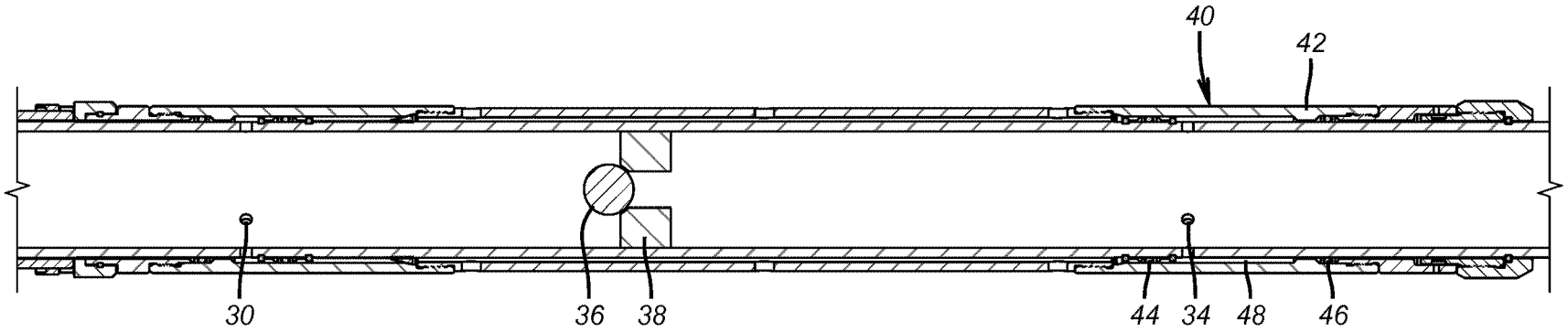
FIG. 2 is a section view of the lower cylinder with a ball on a seat between the cylinders in the ready to apply pressure to set position.

An upper cylindrical piston assembly 22 is formed by outer sleeve 24 and seals 26 and 28 that span upper ports 30 to define a chamber 32 that grows in volume in response to applied pressure in ports 30 when lower ports 34 (shown in FIG. 2) are isolated because a ball 36 is landed on seat 38 and pressure is applied on top of ball 36. Alternative ways to extend the slips 18 would be to lower a setting tool to span over ports 30 and apply pressure.

Lower cylindrical piston assembly 40 is formed by outer sleeve 42 and seals 44 and 46 that straddle openings 34 to define the chamber 48. Assemblies 22 and 40 generate equal and opposite forces when there is no ball 36 on seat 38 and internal pressure is applied in passage 50 that is in mandrel 12. The piston areas in chambers 32 and 48 are equal and opposite so that there is no net force applied to the slip assembly 14 when both ports 30 and 34 are in communication with each other in passage 50. However, once ports 34 are isolated from ports 30 in one of several ways, then pressure on ports 30 represented by arrow 56 will put a net force on slip assembly 14 because the equal and opposite force from pressurizing chamber 48 will not be taking place. As a result the slip assembly 14 will be actuated to move the individual slips 18 up their respective ramps 20 to grip the surrounding tubular that is not shown and by so doing anchor the liner string that is not shown and that is suspended from mandrel 12.

Figure 4:
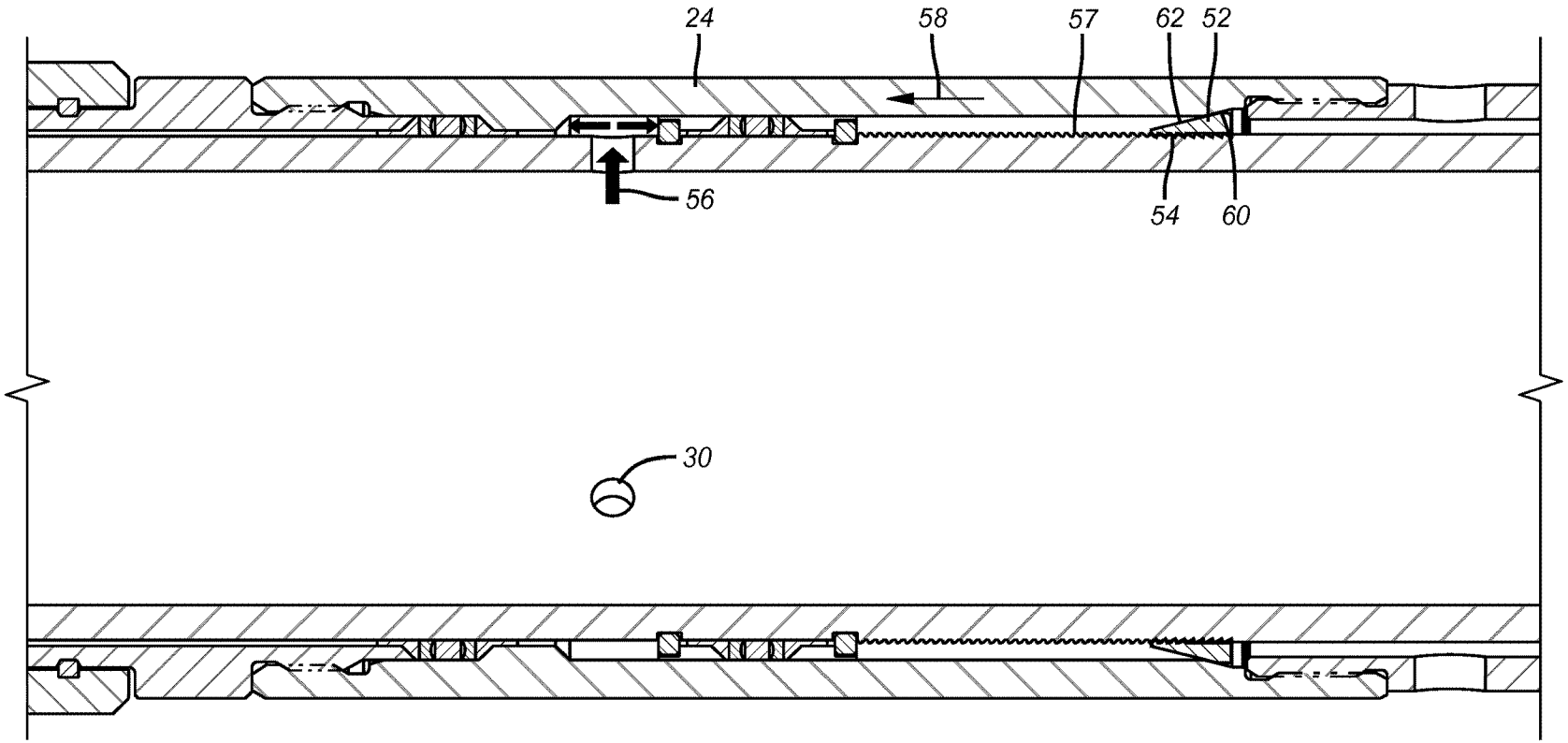
FIG. 4 is a close up view of FIG. 1 showing applied pressure that will extend the slips.
Figure 5:
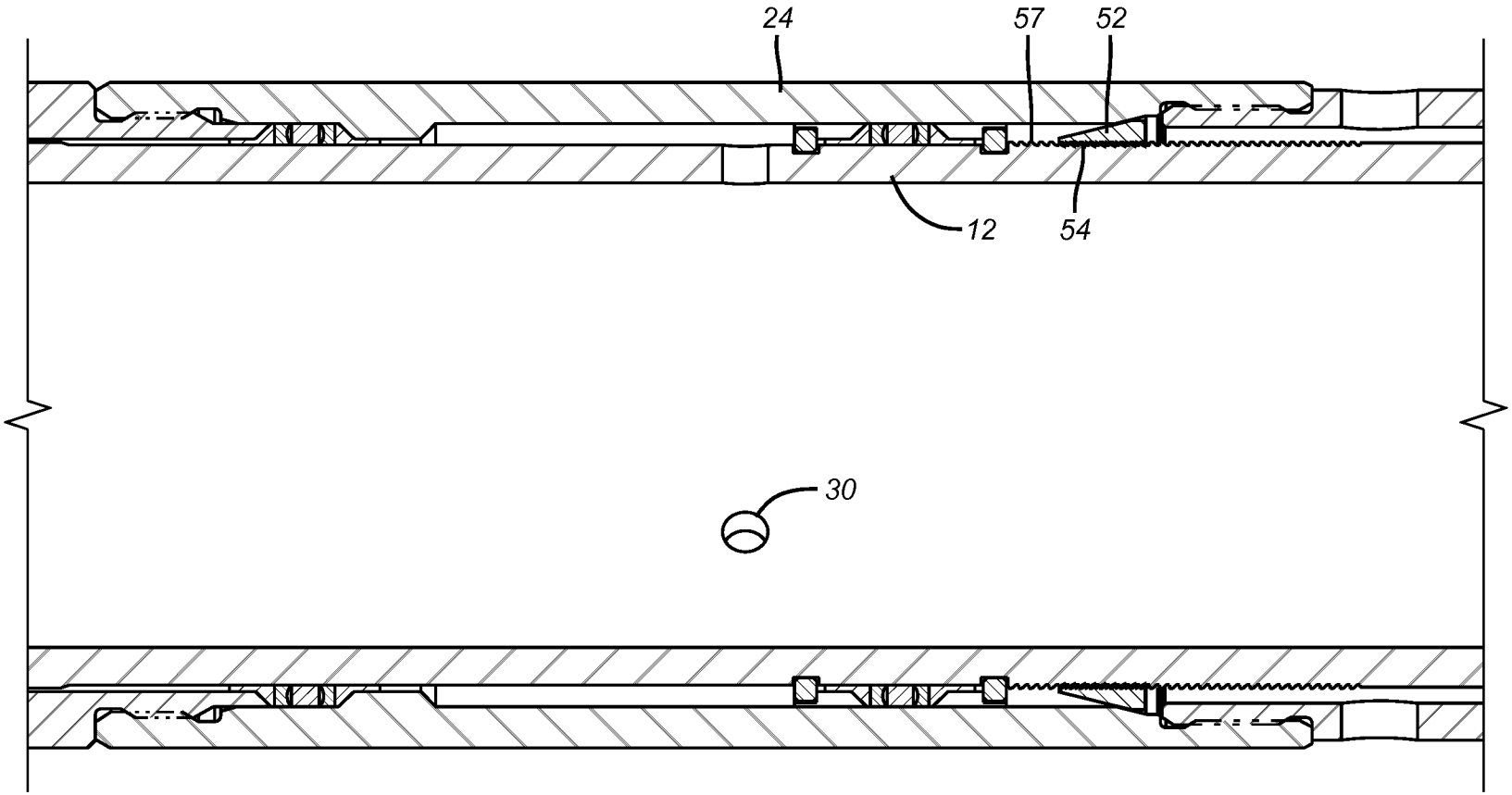
FIG. 5 is a close up of FIG. 3 showing the upper cylinder shifted to extend and lock the set of the slips.

The set locking feature is best seen in FIGS. 4 and 5. The lock ring 52 moves in the direction of arrow 58 with the upper cylindrical piston 24 when pressure is applied at ports 30 only. Ring 52 has a thread pattern 54 facing the mandrel 12 outer surface where there are wickers 57. Movement of the lock ring 52 is in tandem with cylindrical piston 24 in the direction of arrow 58 as the slips 18 are pushed up respective ramps 20. However, movement in the reverse direction of arrow 58 is prevented as the thread 54 of the lock ring will not ratchet over thread or wickers 57 on the mandrel. Taper 60 on the cylindrical piston 24 also pushes into ramp surface 62 on the lock ring 52 to further wedge together threads 54 and 57 to prevent release of the slips 18 by keeping them locked in the extended position up the ramps 20.

Those skilled in the art will appreciate that the disclosed liner hanger will not accidentally set from applied pressure in the mandrel as some other intervention is required to separate ports 34 from ports 30 so that pressure at ports 30 will set the slips. Once set, the body lock ring 52 holds the set so that release is not possible. The slips are bidirectional in resisting force from opposed directions. Preventing the slips from moving until a desired time can be alternatively accomplished with a mechanical lock on the actuator for the slips that is selectively defeated with applied pressure where, for example, a rupture disc is broken that leads to a piston whose movement sets the slips. Alternatively a predetermined pattern of mandrel movement that is induced with string manipulation or pressure cycles with a j-slot mechanism to defeat a lock can also be used. The process of defeating the lock can also be integrated with ramping out the slips in a single fluid motion. The lock in the set position can be accomplished in alternative ways such as letting a snap ring snap into a groove or inserting a dog into adjacent parts with a support to keep such parts from moving relatively when the slips are set.

The above description is illustrative of the preferred embodiment and many modifications may be made by those skilled in the art without departing from the invention whose scope is to be determined from the literal and equivalent scope of the claims below:

We claim:

1. A liner support method, comprising:

overlapping a hanger attached to a string in a surrounding string at a predetermined location;

preventing said hanger from setting by creating opposed equal forces in response to an applied pressure in an open passage of said hanger and communicated to spaced ports communicating to opposed equal piston areas, which comprise an unrestrained actuating assembly, before said predetermined location is reached, said actuating assembly prevented from initial movement at any pressure applied in said open passage;

delivering an object to a seat in said passage between said spaced ports to allow pressurization access to one of said spaced ports in said passage setting said hanger by extending at least one slip assembly to the surrounding string at said predetermined location with pressure in the tubing string against said object on said seat in said passage, said pressure directed to only one side of said unrestrained actuating assembly by isolating one of said ports to pressure in said passage to provide a net force to extend said slip assembly;

locking said at least one slip assembly against said surrounding string.

2. The method of claim 1, comprising:

providing wickers on said slip assembly that resist loads in opposed directions.

3. The method of claim 1, comprising:

accomplishing said locking with a ratchet.

4. The method of claim 1, comprising:

accomplishing said locking with a snap ring or locking dog.

5. The method of claim 1, comprising:

accomplishing said preventing with spaced pistons in pressure communication to a passage in said hanger at spaced locations.

6. The method of claim 5, comprising:

orienting said pistons to move in opposite directions on application of pressure to said spaced locations.

7. The method of claim 6, comprising:

applying pressure on said landed object to move one of said piston to radially extend said slip assembly.

8. The method of claim 6, comprising:

accomplishing said locking with a ratchet.

9. The method of claim 8, comprising:

providing wickers on said slip assembly that resist loads in opposed directions.

10. The method of claim 1, comprising:

accomplishing said locking with a ratchet.

* * * * *